US005521848A

United States Patent [19]

Bayne et al.

[11] Patent Number: 5,521,848

[45] Date of Patent: May 28, 1996

[54] COMPUTER BASED SYSTEM TIMER (CBST)

[75] Inventors: Robert H. Bayne, Kanata; Louis G. Bouchard, Gloucester, both of Canada

[73] Assignee: Her Majesty the Queen as represented by the Minister of National Defence of Her Majesty's Canadian Government, Ottawa, Canada

[21] Appl. No.: 648,784

[22] Filed: Feb. 1, 1991

[30] Foreign Application Priority Data

Feb. 1, 1990 [CA] Canada ..... 2009148

[51] Int. Cl.[6] ..... G07C 3/00; G07C 3/02; G07C 3/08

[52] U.S. Cl. ..... 364/569; 340/679; 340/825.06; 340/825.07; 340/825.08; 340/870.16; 364/550; 377/16

[58] Field of Search ..... 340/825.06, 825.07, 340/825.08, 870.16, 679; 364/550, 569; 377/16

[56] References Cited

U.S. PATENT DOCUMENTS

| | | | |
|---|---|---|---|
| 2,874,368 | 2/1959 | Sibley | 340/825.07 X |
| 3,351,910 | 11/1967 | Miller et al. | 364/569 X |
| 3,867,652 | 2/1975 | Bjorklund et al. | 327/511 |
| 3,902,311 | 9/1975 | Chacon et al. | 368/48 X |
| 4,284,849 | 8/1981 | Anderson et al. | 379/38 |
| 4,418,333 | 11/1983 | Schwarbach et al. | 364/139 X |
| 4,916,439 | 4/1990 | Estes et al. | 340/679 |
| 5,103,409 | 4/1992 | Shimizu et al. | 364/556 |
| 5,155,693 | 10/1992 | Altmayer et al. | 364/550 |
| 5,175,730 | 12/1992 | Murai | 340/825.07 X |
| 5,189,409 | 2/1993 | Okuno | 340/825.06 |

*Primary Examiner*—Edward R. Cosimano
*Attorney, Agent, or Firm*—Nixon & Vanderhye

[57] ABSTRACT

A monitoring system for automatically logging the accumulated operational hours of a plurality of instruments is disclosed herein. The monitoring system has the capability of monitoring a large number of instruments that may be remotely located. The monitoring system of the present invention is devised to continually monitor the on/off state of each instrument and hence measure the amount of time that each instrument is in an operational mode.

10 Claims, 3 Drawing Sheets

COMPUTER BASED SYSTEM TIMER (CBST)

FIELD OF THE INVENTION

It is the aim of the invention to provide a monitoring system for automatically logging the accumulated operational hours of a plurality of instruments.

BACKGROUND OF THE INVENTION

There is a need to measure the accumulated operational hours of certain instruments in order to calculate the Mean Time Between Failure (MTBF) of these instruments. One such requirement exists for a monitoring system for navigational instruments.

The monitoring system must have the capability of monitoring a large number of instruments that may be remotely located. In particular on board a ship there may be numerous instruments that are distributed in different locations and would be difficult to monitor from one position by one person.

SUMMARY OF THE INVENTION

The monitoring system of the present invention is devised to continually monitor the on/off state of each instrument and hence measure the amount of time that each instrument is in an operational mode.

Accordingly, a monitoring system for continually monitoring an on/off state of a plurality of instruments is disclosed which comprises a monitoring system for continually monitoring an on/off state of each of a multiplicity of instruments comprising: a central computer system; a main controller interactively connected with the central computer system; a plurality of remote microprocessors interactively connected to said main controller; a means for setting a unique address for each of said remote microprocessors; and a plurality of breaker boxes with each said breaker box being interactively connected to a plurality of related instruments, and being interactively connected with a corresponding remote microprocessor wherein each of said breaker boxes has a sensing means for indicating said state of each related instrument.

BRIEF DESCRIPTION OF THE DRAWING

For a more complete understanding of the present invention and the advantages thereof, reference is now made to the following description, taken in conjunction with the accompanying drawings in which.

DESCRIPTION OF THE PREFERRED EMBODIMENT

Figure 1:
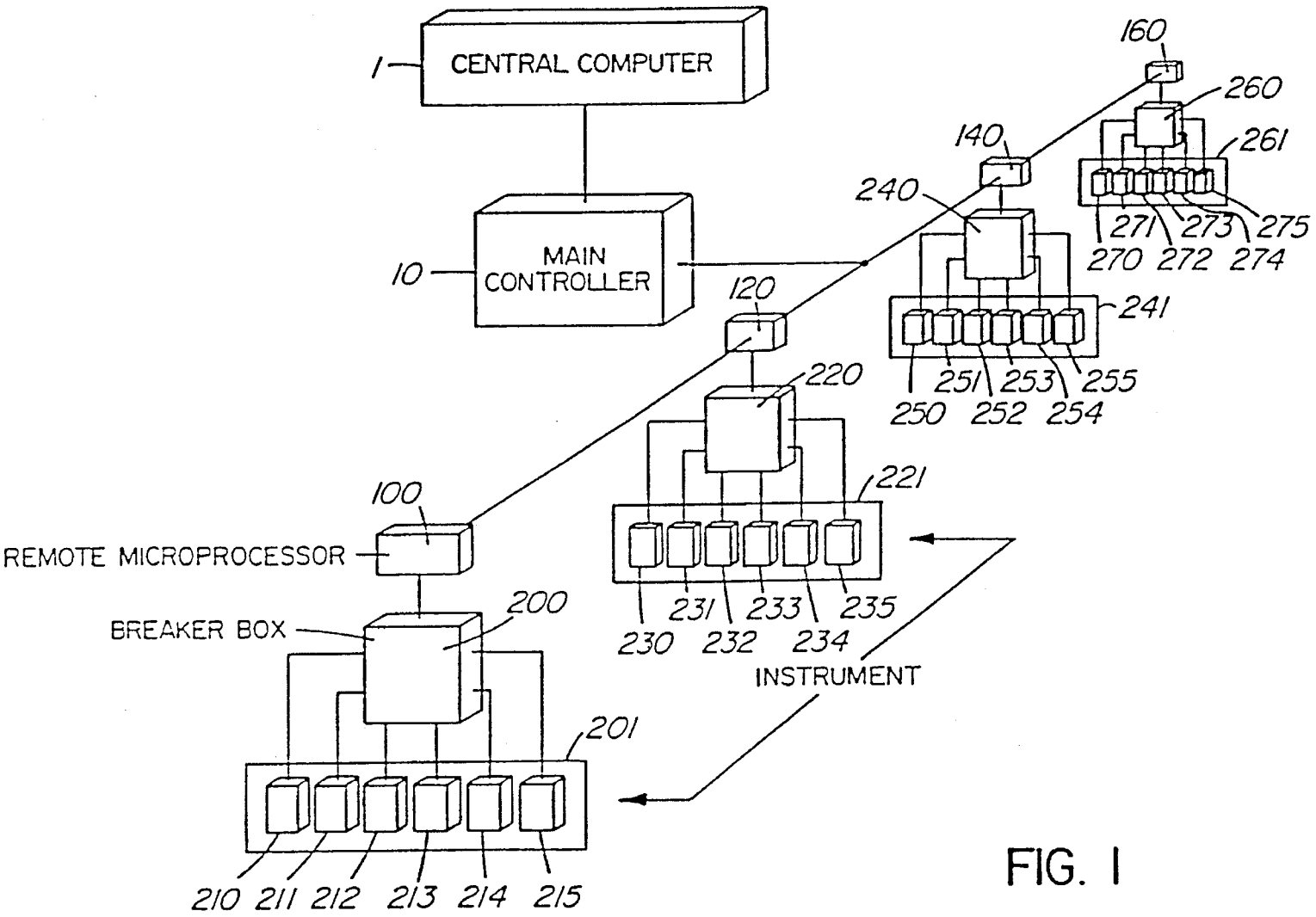
FIG. 1 is a block diagram illustrating one embodiment of the monitoring system with the various devices in place.

One embodiment of the monitoring system is illustrated in FIG. 1. The monitoring system is comprised of a central computer 1, a main controller 10, a plurality of remote microprocessors 100, 120, 140 and 160, and a plurality of breaker boxes 200, 220, 240 and 260. These are conventionally connected together in a manner known in this art.

Although only four remote microprocessors 100, 120, 140 and 160 have been illustrated, the main controller 10 is capable of controlling two hundred and fifty-six such microprocessors. At the other extreme only one remote microprocessor may be used in the monitoring system. Each remote microprocessor controls a related breaker box, for example the remote microprocessor 100 may control breaker box 200. Although it is possible to have a plurality of microprocessors and breaker boxes only four have been illustrated in FIG. 1. For convenience the description of said remote microprocessors 100, 120, 140 and 160 and the description of said breaker boxes 200, 220, 240 and 260 will be made with reference to remote microprocessor 100 and breaker box 200 respectively. The operation and function of each microprocessor and its corresponding breaker box, of this invention, is the same.

The breaker box illustrated at 200 is shown having sensors for sensing the state of a maximum number of six instruments 210, 211, 212, 213, 214 and 215 in a sensor group 201. The state of each instrument 210, 211, 212, 213, 214 and 215 is determined by the current flow inside a wire feeding the instruments with power. If a current flow is detected by the sensors, that indicates that the instrument is on. Conversely, if no current is detected that indicates that the instrument is off. Each of the breaker boxes 200 has a means for transmitting information regarding the flow of current to a corresponding remote microprocessor 100. One such means for transmitting that information is a transducer affixed to the sensors. Breaker box 220 has sensors for instruments 230–235 in a sensor group 221, while breaker box 240 has sensors for instruments 250–255 in a sensor group 241 and breaker box 260 has sensors for instruments 270–275 in a sensor group 261.

The remote microprocessor 100 has an input port as a means for receiving and storing said information from the corresponding breaker box 200. The remote microprocessor 100 also has other input ports as means for receiving an address from what in the computer field is known as a dip switch, as a means which sets a unique address for each of said remote microprocessors 100, 120, 140 and 160. Hence each remote microprocessor of the monitoring system has a unique address. Also the microprocessor 100 has an input and an output from a means which transfers information between said microprocessor and the main controller 10.

Each remote microprocessor is controlled by a program stored in a PROM within the microprocessor. When the monitoring system is first turned on the remote microprocessor 100 reads an address from the dip switch which sets a unique first address for each remote microprocessor. Next the remote microprocessor 100, waits for a second address from said means that transfers information between said microprocessor and main controller 10. If an address is received by the remote microprocessor 100 then the second address is compared to said first address. If said two addresses are different then the microprocessor waits for the next address that is sent from said main controller 10, and the next microprocessor 120 receives that next address and the process is continued until a match between the addresses is made. If two addresses match then said remote microprocessor 100 receives current flow status information from a related breaker box 200. The corresponding remote microprocessor 100 will transmit that current flow status information to said main controller 10 via the transferring means.

The remote microprocessor 100 may be an Intel 8051 microcontroller. The current flow information may be transferred from said microprocessor 100 to said main controller 10 through a RS-422 balanced line. Also to minimize wiring, half duplex communication is preferably set up through single twisted pairs of wires in half duplex mode. A second twisted pair of wires on the same cable may be used to provide power from said main controller 10 and each of the remote microprocessors.

The main controller 10 sends down an address to the microprocessors 100, 120, 140 and 160 sequentially through said transferring means. A response is returned with the current flow status information from an addressed microprocessor having an address matching that sent by the main controller. The accumulated time during which an instrument has been drawing current is calculated by said main controller 10 from said status information. This accumulated time is stored as information in main controller 10. Once that information has been stored the next address of the next microprocessor to be polled is sent down to the microprocessors 100, 120, 140 and 160. After all microprocessors have been polled the process is repeated. Under software control the information on accumulated time which has been stored in said main controller 10 is uploaded to said central computer 1. The central computer 1 functions as a user interface.

Figure 2:
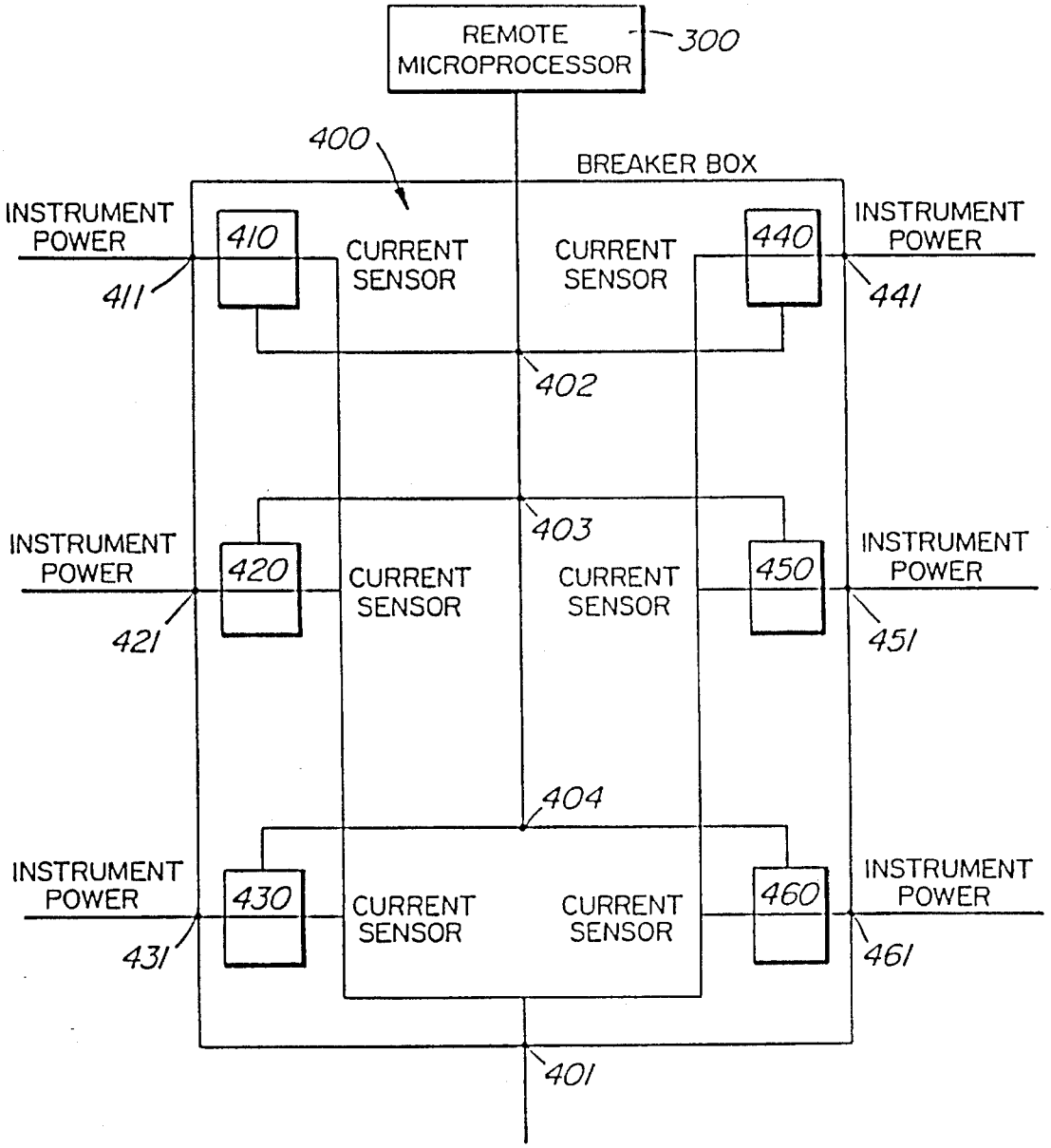
FIG. 2 is a block diagram illustrating one configuration of the Breaker Box.

The details of the Breaker Box 400 configuration are shown in FIG. 2. The Breaker Box may have a maximum of six instrument power inputs at points 411, 421, 431, 441, 451 and 461. Point 401 is a common electrical connection for the instruments. The Breaker Box 400, which represents all of the Breaker Boxes of this invention, monitors the current supplied to each instrument. The on-state of each instrument is indicated by a current flow being sensed by a respective current sensor 410, 420, 430, 440, 450 or 460. The off-state of each instrument is similarly indicated by the sensing of no current flow by said current sensors 410, 420, 430, 440, 450 or 460. In this embodiment each of said current sensor is a current transducer comprised of a non-intrusive Hall-Effect switch which detects the magnetic field in a core that wraps around the wire. With the use of this type of current sensor the current flow may be detected without additional electrical loading of the circuit. The state of operation of the instruments is transmitted through points 402, 403 and 404 to said microprocessor 300.

Figure 3:
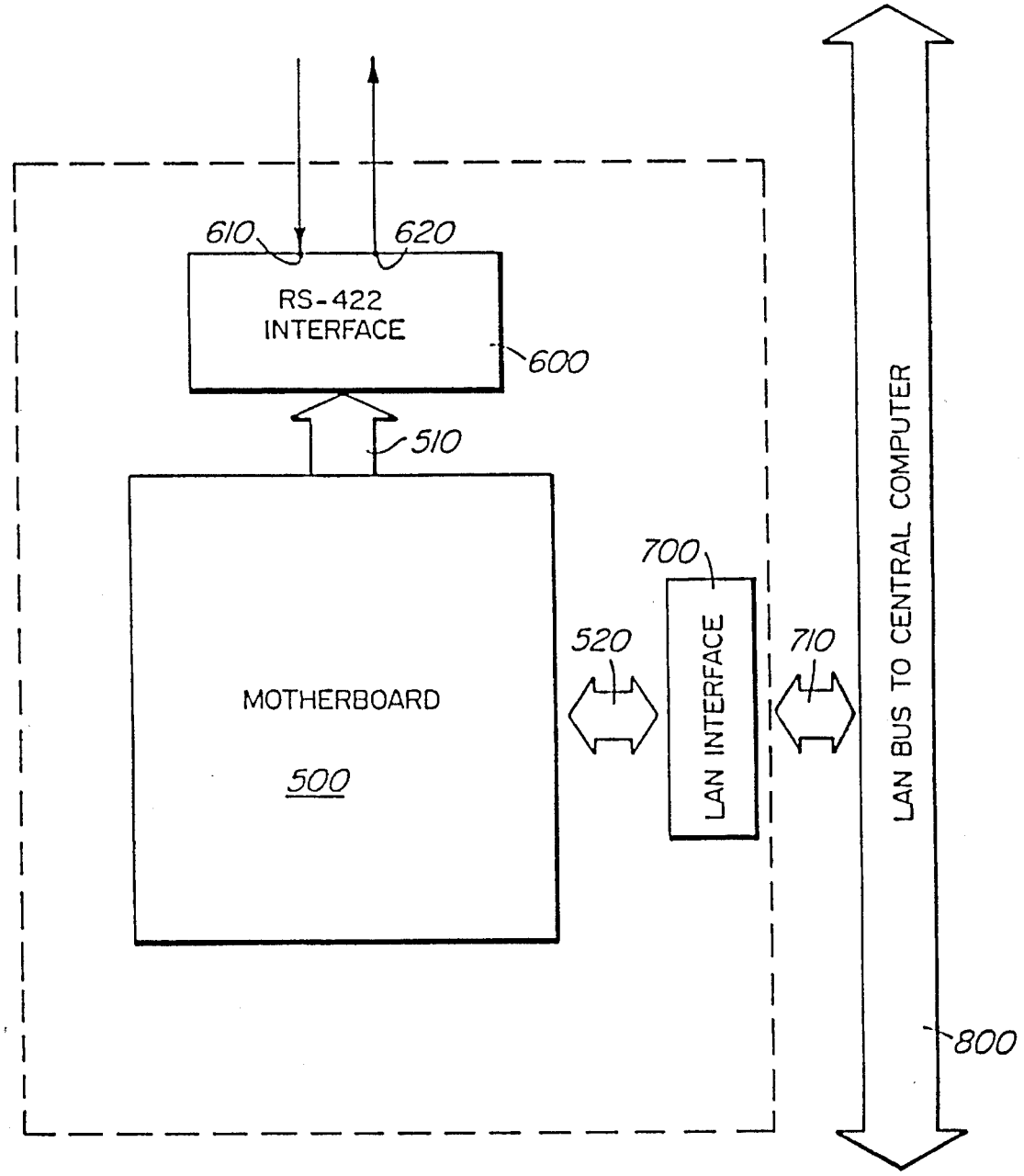
FIG. 3 is a block diagram of one configuration of the main controller.

We refer now to FIG. 3 for a more detailed description of said main controller 500. The main controller 500 is preferably a PC motherboard wired and fitted having capabilities known in the art. Such a PC motherboard is an IBM PC motherboard or the like. The main controller 500 sends an address to said microprocessor of FIG. 2 through a port 510. This address information may then be transferred through the RS-422 interforce 600 and balanced line 610, 620. The transfer of information from said main controller 500 to said central computer 1 of FIG. 1 may be done through a bus 520, LAN interface 700 a bus 710 and an LAN* Bus 800 to said central computer.

Although the monitoring system of the present invention has been illustrated by one specific embodiment with reference to specific computer hardware and specific bus systems other computer hardware and bus systems may alternatively be used in a monitoring system which can perform the same function without departing from the spirit and scope of this invention.

The embodiment of the invention in which an exclusive property or privilege is claimed are defined as follows:

1. A monitoring system for continually monitoring an on/off state of each of a multiplicity of instruments comprising:

a central computer;

a main controller interactively connected with said central computer;

a plurality of remote microprocessors interactively connected to said main controller;

means for setting a unique address for each of said remote microprocessors;

a plurality of breaker boxes, each breaker box being interactively connected to a plurality of related instruments and a corresponding remote microprocessor, wherein each of said breaker boxes includes a sensing means for sensing and indicating a sensed ON/OFF actuation state of each related instrument;

first means for transferring sensed ON/OFF actuation state information to the corresponding remote microprocessor; and second means for transferring said information from said remote microprocessor to said main controller from which said main controller calculates and stores accumulated operating time for each instrument.

2. The monitoring system of claim 1 wherein said second means for transferring said information includes a balanced line.

3. The monitoring system of claim 2 further comprising:

third means for transferring information between said central computer system and said main controller including a LAN interface.

4. The monitoring system of claim 1 where said breaker box further comprises:

a plurality of sensors with each sensor connected to one of said instruments for detecting current flow.

5. The monitoring system of claim 4 where each sensor comprises a non-intrusive Hall effect switch for detecting the magnetic field in a core that wraps around a wire.

6. The monitoring system of claim 1 further comprising:

third means for transferring to said central computer the accumulated operating time for each instrument from said main controller.

7. The monitoring system of claim 6, said breaker box further comprising:

a plurality of sensors with each sensor connected to one of said instruments for detecting current flow.

8. The monitoring system of claim 7 wherein each sensor includes a non-intrusive Hall effect switch for detecting a magnetic field in a core that wraps around a wire.

9. The monitoring system of claim 8 wherein said second means for transferring includes a balanced line.

10. The monitoring system of claim 9 wherein said third means for transferring information between said central computer system and said main controller includes a LAN interface.

* * * * *